US006957930B2

(12) United States Patent
Landau

(10) Patent No.: US 6,957,930 B2
(45) Date of Patent: Oct. 25, 2005

(54) APPARATUS TO FORM COLUMNS OF GRANULAR MATERIAL

(76) Inventor: Richard E. Landau, 768 Springfield Ave. (B-6), Summit, NJ (US) 07901

( * ) Notice: Subject to any disclaimer, the term of this patent is extended or adjusted under 35 U.S.C. 154(b) by 0 days.

(21) Appl. No.: 10/364,066

(22) Filed: Feb. 11, 2003

(65) Prior Publication Data

US 2003/0123937 A1 Jul. 3, 2003

Related U.S. Application Data

(63) Continuation-in-part of application No. 09/388,073, filed on Sep. 1, 1999, now Pat. No. 6,517,292.

(51) Int. Cl.[7] ..... E02B 11/00; E02D 5/34

(52) U.S. Cl. ..... 405/233; 405/50; 405/232; 405/240; 175/20

(58) Field of Search ..... 405/50, 232, 233, 405/236, 240, 241; 175/20, 171, 323, 394; 52/155, 157, 158, 169.13, 705, 707

(56) References Cited

U.S. PATENT DOCUMENTS 2,822,671 A * 2/1958 Dentz et al. ..... 405/243
3,096,622 A * 7/1963 Landau ..... 405/50
3,300,988 A * 1/1967 Phares et al. ..... 405/239
3,303,656 A * 2/1967 Landau ..... 405/50
3,604,214 A * 9/1971 Turzillo ..... 405/241
3,648,467 A * 3/1972 Ogawa ..... 405/240
3,690,109 A * 9/1972 Turzillo ..... 405/241
3,707,848 A * 1/1973 Chelminski ..... 405/45
3,772,892 A * 11/1973 Ogawa ..... 405/171
3,772,894 A * 11/1973 Godley et al. ..... 405/50
4,269,544 A * 5/1981 Rusche ..... 405/233
4,311,416 A * 1/1982 Rusche ..... 405/232
4,433,943 A * 2/1984 Pao Chen ..... 405/241
4,444,278 A * 4/1984 Rocchetti ..... 175/108
4,645,381 A * 2/1987 Leflaive et al. ..... 405/302.4
5,242,246 A * 9/1993 Manchak et al. ..... 405/128.85
5,256,003 A * 10/1993 Ito et al. ..... 405/232
5,419,839 A * 5/1995 Haley et al. ..... 405/129.2
5,452,967 A * 9/1995 Fuller ..... 405/184
6,171,024 B1 * 1/2001 Curtis et al. ..... 405/128.45
6,231,270 B1 * 5/2001 Cacossa ..... 405/248
6,517,292 B1 * 2/2003 Landau ..... 405/233

* cited by examiner

*Primary Examiner*—Jong-Suk (James) Lee

(57) ABSTRACT

Apparatus to install small diameter columns of granular material in soil which includes rotating hollow shaft mandrel with external projections to aid mandrel advance into the soil and define the size of the cavity formed in the soil, the cavity being filled with granular material to form the column as the mandrel is withdrawn. The apparatus includes a storage hopper in the vicinity of its base, with the hopper sized to hold material to form more than one column, from which material is incrementally conveyed or pumped to a feed tank system which supplies granular material to the cavity along a flow path extending through the hollow shaft mandrel to produce the column. When a group of columns is required, as in a sand drain grid, the columns can be completed sequentially with reasonable continuity in the multiple column formation cycle.

20 Claims, 2 Drawing Sheets

APPARATUS TO FORM COLUMNS OF GRANULAR MATERIAL

This application is a continuation-in-part of application Ser. No. 09/388,073, filed Sep. 1, 1999, now U.S. Pat. No. 6,517,292.

BACKGROUND OF THE INVENTION

This invention is an improvement in methods and equipment for installing small diameter columns of granular material in soil, including installation of granular drains, which permits column formation in soil without the loss of time related to interruption of the production cycle to supply granular material used to form the columns in soil. The equipment for column installation is configured to minimize weight applied to the hollow shaft cavity forming element or tool, termed "mandrel", as compared to other apparatus applicable to the installation of small diameter columns of granular material in soil.

DESCRIPTION OF THE PRIOR ART

Equipment used for the installation of small diameter columns of granular material in soil, such as in U.S. Pat. No. 5,647,690, has a hopper mounted on a cavity forming tool, and incorporates means to interrupt flow of granular material from the hopper after each column is formed to retain material to fill cavities at additional column locations. The dimensions and weight of the hopper and granular material contained to form more than one column requires large mobile apparatus to support and move the equipment to a succession of column locations. The column formation cycle, which includes moving from one column location to the next, is interrupted each time the quantity of granular material in the hopper mounted with the cavity forming tool diminished to the point where granular material needs to be added to complete subsequent columns. When the column of granular material has a circular drain, its diameter is normally on the order of 2" and the cavity forming tool is usually at least 20' in length. With the weight of the hopper and contained material applied at or near the top of cavity forming tool as it advances into soil, the small cavity forming tool needs to be supported incrementally to avoid rupture due to overstress and structural fatigue associated with lateral deflection and under the weight of the hopper and granular material during its linear advance into soil, which is aggravated when the cavity forming tool is being rotated in its advance. Rotary drives used to advance flight augers or other cavity forming tools into soil are commonly positioned at or near the top of the tool and move with the tool. Stationary rotary drive systems used in column formation is soil are available to be positioned at the lower end of support equipment, where the rotating output drive permits a shaft with an angular cross-section, such as a "Kelly Bar", to slide through it to advance a section of flight auger into soil. As the length of the flight auger is limited to the space available between the rotary drive and the soil being penetrated, cavities which are longer than the flight auger require the full length of the cavity to be formed by the incremental and repetitive advance and withdrawal of the short section of auger.

SUMMARY OF THE INVENTION

It is the object of this invention to reduce the cost of granular column installation and increase the durability of the cavity forming tool, such as by reconfiguring equipment disclosed in U.S. Pat. Nos. 5,647,690, 3,690,109 and others to minimize the weight supported by the tool advance into soil to form the cavity, and to avoid interruption of the column formation cycle when the supply of granular material diminishes and needs to be replenished to continue column formation.

The procedure to form columns includes: a storage hopper at or near the base of the equipment to hold sufficient granular material, termed "backfill" to complete multiple columns; a hollow shaft tool, termed "mandrel", supported by the equipment in a manner that enables force to be applied in its advance into and withdrawal from soil to form a cavity; means to move backfill from the storage hopper to and through the mandrel to fill the cavity to form the column; and means to relocate the equipment and storage hopper as needed to form subsequent columns. Locating the storage hopper at or near the base of the equipment enables it to be replenished with granular material without interrupting the column forming cycle. The weight of the cavity forming tool and conjoined elements may be sufficient to advance the tool into the soil; however, added linear and rotational force or forces may be applied as needed to increase its rate of advance and reduce the cycle time for column completion. Variations in the arrangement of equipment described and means to expedite cavity formation and applied forces, within the context of the present invention, will be evident to those familiar in the art.

The backfill is moved as needed from the storage hopper to a feed tank at or above the hollow shaft by means of a conveyor system, pumping, by applying fluid pressure or a combination of these. In the present invention, where the feed tank is used it need only contain sufficient backfill to form a single column at a time. The feed tank, which need not be circular, is configured with an inlet to accept the granular material and an outlet through which backfill passes into and through the hollow shaft tool. After backfill is supplied to the feed tank, its inlet is closed and fluid under pressure is introduced in a manner to cause backfill to move through the feed tank outlet into and through the hollow shaft tool and into the cavity formed as the hollow shaft tool is withdrawn from the soil to complete a column. As it needs to contain granular material to form a single column, the feed tank size of this invention can be substantially smaller than required to implement U.S. Pat. No. 5,647,690. The weight of the feed tank and granular material is also less as compared to that in U.S. Pat. No. 5,647,690, the frequency of repair and related costs and interruption to production are expected to decrease. Also, the feed tank may be positioned to receive granular material without interfering with the hollow shaft tool advance into the soil, as the feed tank may be separated from the hollow shaft tool until backfill needs to be supplied to the hollow shaft tool during its removal from the soil to form the cavity to complete the column. Alternatively, the feed tank may be filled with the small quantity of granular material needed in the time interval to move the equipment from one column location to the next. To minimize the potential for waste of material moved from the storage hopper to the feed tank, an intermediate feed hopper may be positioned on the equipment at the upper end of the elongated system moving material from the storage hopper, to guide and if necessary to contain backfill material supplied to the feed tank.

A foaming agent, such as PS 356 supplied by Master Builders, Inc. may be added to granular material to render it suitable to be moved by pumping. Whereas foaming agents may degrade over a short period of time, commercially available defoaming agents may be introduced into the granular material when filling the cavity to more rapidly eliminate the effects of the foaming agent in the backfill of the completed column. The need for a feed tank may be avoided when the granular material is moved by connecting the elongated system through which backfill is pumped to the inlet of the hollow shaft tool in a manner to move the granular material into the cavity at a rate needed to it fill the cavity formed as the hollow shaft is withdrawn from the soil to properly complete the column. In the instance where a feed tank is used in conjunction with pumping, the backfill is pumped into the feed tank, where a defoaming agent may be applied to restore the quality of the original granular material which is then moved into and through the hollow shaft tool to form the column in soil as previously described.

The mandrel may be circular or angular. External projections may be applied to increase the rigidity of the hollow shaft tool to reduce deflection and better support forces applied in its advance during cavity formation. A mandrel with helical flight as projections, termed "flight auger", may be used to minimize soil displacement as described in U.S. Pat. No. 3,096,622. The force or forces for the linear and rotational advance into soil of the mandrel with and without projections may be applied to the hollow shaft element directly or indirectly through an element or elements conjoined to the mandrel. The shape of the mandrel as well as projections from the mandrel may be utilized to transmit force for its rotation in its advance into the soil as well as to define the shape of the cavity and column formed, and in this configuration the means applying rotational force to the mandrel may be positioned at any point along the mandrel length including the lowest accessible point of the equipment.

The invention also provides a configuration of a circular cavity forming tool, such as a flight auger, to be configured so as to be rotated by a drive positioned at the low end of the support equipment in a manner that permits a full length flight auger to be rotated into the soil to form the required cavity by a single advance and withdrawal of the flight auger.

BRIEF DESCRIPTION OF THE DRAWINGS

The present invention will be more fully understood by reference to the following detailed description in conjunction with the attached drawings, wherein.

DETAILED DESCRIPTION OF THE DRAWINGS

Figure 1:
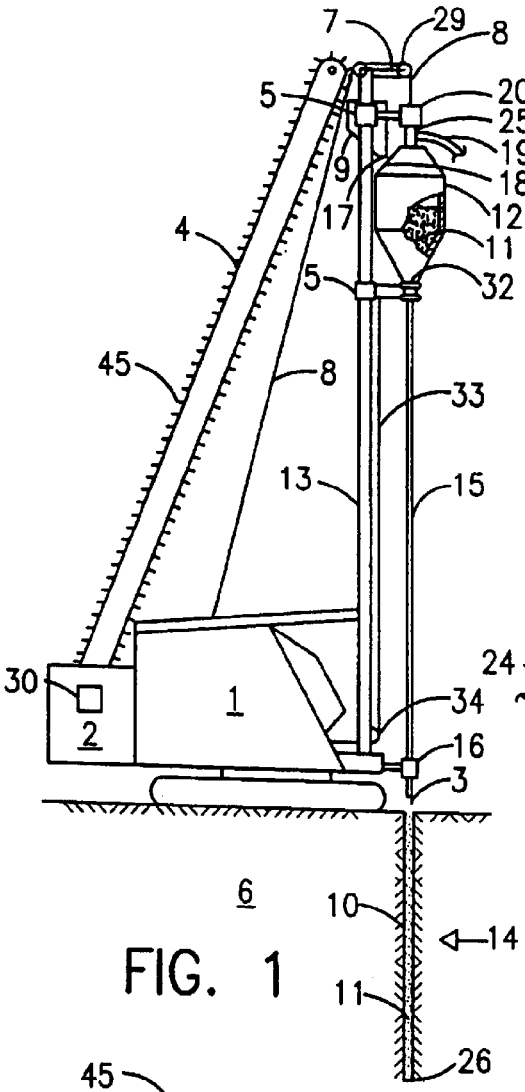
FIG. 1 shows one embodiment of the present invention which utilizes a mandrel and a form of bucket conveyor and related elements to install columns of granular material, such as sand drains.

The embodiment of the invention in FIG. 1 incorporates unit 1 to provide mobile support and operational capability to the equipment which includes a backfill material storage hopper 2, track support 13, and other appurtenances. Carriage 5, which slides moves on track support 13, may be used to align and support feed tank 12 which contains material 11 to backfill the cavity formed by a pipe or hollow mandrel 15 to form column 14. Hose/swivel combination 19/25 supplies air under pressure to feed tank 12 to aid in moving backfill 11 from feed tank 12 to aid in moving backfill 11 from feed tank 12 through mandrel 15 and into cavity 10 to form column 14. Guide 16 fixed at the lower end of unit 1 may be used to maintain the alignment of mandrel 15 during its advance and removal from soil 6. Jib 7 can be used to guide flexible cable 8 fixed to feed tank 12 to control travel of conjoined mandrel 15 toward and through soil 6 and its withdrawal outward from soil 6 in the column forming process. Drive 30 is positioned to operate conveyor 4 to move backfill material 11 from storage hopper 2 to feed hopper 9 on track support 13.

Feed hopper 9 containing backfill material 11 is aligned with its outlet 17 toward entry 18 to permit passage of backfill material 11 to the open entry of feed tank 12 each time mandrel 15 is withdrawn from soil 6. Delivery of material by conveyor 4 to feed hopper 9 is monitored to deliver approximately the required amount of backfill 11 for transfer to tank 12 to form column 14. Under static conditions, backfill 11 arches at the outlet 32 at the base of tank 12 and little or no flow of granular material 11 will occur into mandrel 15.

The weight of mandrel 15, tank 12, backfill material 11 and other elements moving with rotary drive 20 on a carriage 5 and possibly other forces, such as cable 33 attached to another carriage 5 and guided by pulley 34, are applied to advance mandrel 15 into soil 6. Cap 3, which is initially open causing tank 12 to lose its pressure, is closed when mandrel 15 is positioned at the point of column formation and cap 3 contacts the soil which holds it closed during advance through the soil to the required depth 26. With cap 3 in its open position when the soil cavity 10 formed as mandrel 15 is withdrawn, air pressure or other applied means, such as vibration, causes flow of backfill material 11 from tank 12 through mandrel 15 to form the required column. In this manner, the cross-section of column 14 is expected to reflect the shape of mandrel 15. Backfill material 11 is moved upward from storage hopper 2 to feed hopper 9 by means of conveyor 4, with cradles 45 sized and spaced as needed to move backfill 11, operated by drive 30. Conveyor 4 can be activated at any time during the time of column formation as well as during the time interval involved in relocating unit 1 to its next column location. Full withdrawal of the mandrel exposes the open ended mandrel and tank 12 loses its pressure. With mandrel 15 fully extracted from soil 6 at the completion of a column and feed hopper 9 and its outlet 17 aligned with inlet 18 open in tank 12, backfill material 11 is again caused to flow from feed hopper 9 to feed tank 12 through entry 18 and the column forming process is repeated. The time available to move backfill material from storage hopper 2 on unit 1 by conveyor 4 to feed hopper 9 and feed tank 12 positioned at the highest level of track support 13 is closely equal to the time between the start of soil cavity formation and the time unit 1 is positioned at its next location and avoid interruption to the column forming cycle. Storage hopper 2 may be refilled at any time, however it is best that it holds sufficient material to have refilling done at scheduled breaks in production.

Feed hopper 9 may be eliminated by altering the embodiment in FIG. 1 to permit tank 12 to be temporarily separated from mandrel 15 when tank 12 reaches the point on track support 13 for conveyor 4 to supply granular material 11 to tank 12 while mandrel 15 is advanced by its own weight or added force. Tank 12 with material 11 is repositioned on mandrel 15 on or before mandrel 15 reaches depth 26 in soil 6.

Figure 2:
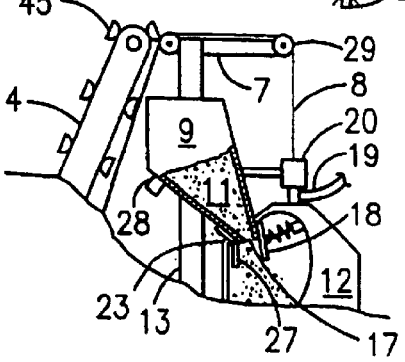
FIG. 2 shows a configuration of the feed hopper outlet where the backfill tank portal is weighted or spring loaded to be normally closed, and is forcibly opened by the outlet of the feed hopper at the feed tank. In this configuration, as the feed hopper obstructs passage of the feed tank, the feed hopper would be positioned sufficiently high on the equipment to permit the mandrel to be fully withdrawn from the soil. While not detailed in FIG. 2, the feed tank inlet may be configured to open and/or close by means other than the feed hopper outlet, in which instance the feed hopper outlet need not obstruct passage of the feed tank and as a result the feed hopper can be positioned at any location along the equipment that can be reached by the feed tank. In either configuration, the movement of backfill from the feed hopper to the feed tank may be by gravity and may be assisted by vibration, air flow or other means. The means to implement aspects not detailed in FIG. 2 will be evident to those familiar in the art.

FIG. 2 shows a configuration of outlet 17 of hopper 9, where normally closed pivoted portal 27 is shaped in a manner that contact with the edge of inlet frame 23 of tank 12 opens portal 27, and outlet 17 of feed hopper 9 is shaped to open pivoted inlet portal 18 of tank 12 at the same time, so as to permit material 11 to pass from feed hopper 9 to tank 12. Vibrator 28 is shown, which is one of various means to expedite flow of material 11.

Figure 3:
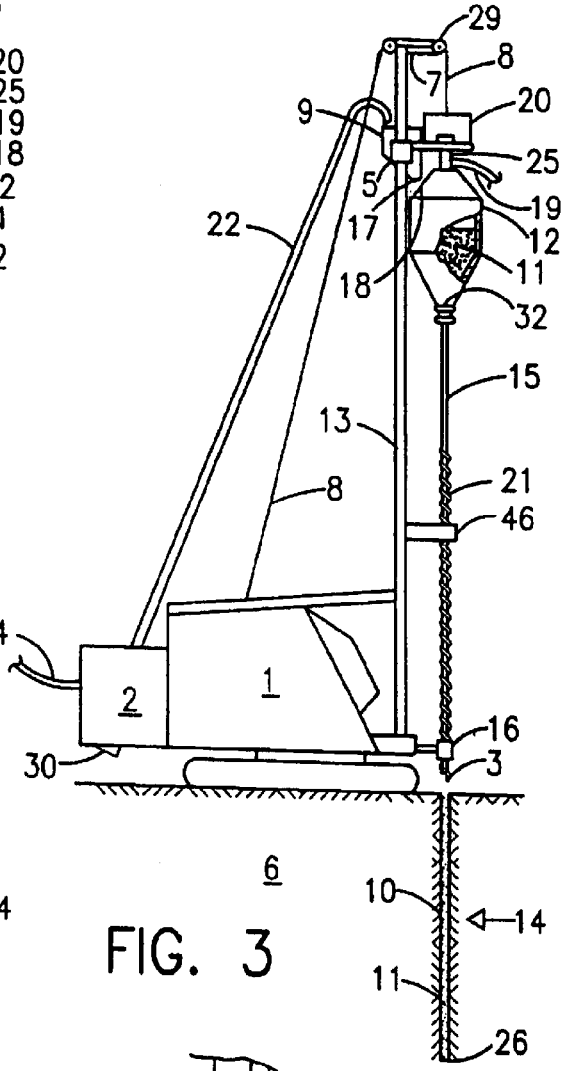
FIG. 3 is a second embodiment of the present invention which utilizes rotation to advance the mandrel configured as a flight auger incorporates a conveyor that may utilize air under pressure to flow backfill to the hopper to feed granular material into elements related to installation of columns of material in soil. This configuration may be applied to moving granular material from the storage hopper to the feed tank by pump.

FIG. 3 is an embodiment of the invention incorporating unit 1 to operate the equipment and provide mobile support for elements such as backfill material storage hopper 2, track support 13, and other elements such as carriage 5 to support rotary drive 20 used to rotate tank 12 and mandrel 15 with helical flights 35 forming flight auger 21. Hose 19 supplies fluid, such as air, under pressure through swivel 25 to tank 12. Elongated system 22 may be open or closed when it includes a screw type or other conveyor means operated by drive 30 to move granular material 11 from hopper 2 to feed hopper 9 on track support 13. Fluid, such as air, under pressure may be applied, such as through hose 24, to move backfill 11 through elongated system 22, in which instance elongated system 22 is a peripherally closed system, such as a pipe. Hopper 2, which is normally open to accept granular material 11 when needed, may also be configured to close if necessary when elongated system 22 uses fluid pressure to move or assist in moving granular material 11. Flight auger 21 advances into soil by virtue of its weight and that of conjoined elements as well as a result of the rotating inclined plane shape of flights, 21, creating forces that in effect pulls itself into the soil as is evident to those familiar in the art. Although not shown, cable 33 and pulley 34 shown in FIG. 1 may also be incorporated in FIG. 2, if needed, to aid in advancing flight auger 21.

Mandrel 15 is configured with one or more helical flights 35 to form flight auger 21. Guide 16 positioned at the low end of unit 1 may be used to guide flight auger 21. Pulley 29 on jib 7 is used to guide flexible cable 8 fixed to tank 12 to control travel of flight auger 21 in its advance into and withdrawal from soil 6. The quantity of backfill 11 moved by elongated system 22 to feed hopper 9 and feed tank 12 may be controlled to limit waste in the quantity of granular material used to form column 14.

Feed hopper 9 containing backfill 11 aligns with its outlet 17 toward entry 18 which is open to permit backfill 11 to move into feed tank 12 at entry 18 each time auger 21 is fully withdrawn from soil 6. Under static conditions granular backfill 11 arches at the base of tank 12 and little or no flow of granular material 11 will occur through the hollow shaft auger 21 without fluid flow or other force. To form a column, flight auger 21 is positioned at the point of column formation in a manner for cap 3 to be held in its closed position by the ground surface and soil 6 during its advance to depth 26. The rotation and weight of auger 21 and tank 12 with backfill material 11 advance auger 21 into soil 6. Cap 3 displaces to open the flow path of material 11 to cavity 10 formed as flight auger 21 is withdrawn from soil 6. With cap 3 open in soil 6, fluid pressure or other means applied at tank 12 causes and/or assists the flow of backfill 11 from tank 12 to flight auger 21 and into cavity 10 to form column 14. Withdrawal of the auger 21 from the soil is normally done without reverse rotation, and column 14 reflects the cross-section and depth of flight auger 21 advance. Feed tank 12 loses pressure when cap 3 is open above ground. Restraints 46 are designed to allow feed tank 12 to pass, minimize mandrel 15 deflection.

Figure 4:
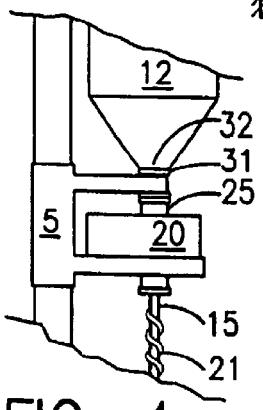
FIG. 4 supplements FIG. 2, with a variation wherein the feed tank is not required to rotate during auger advance into the soil.

FIG. 4 shows a variation of the embodiment of FIG. 1 and FIG. 3, where support 5 and drive system 20 are positioned below tank 12 where tank 12 is conjoined with swivel 25 and thrust bearing 31, if needed, in a manner to permit the passage of backfill 11 from tank 12 though swivel 25 and through the mandrel 15 in any of its configurations. Another variation enables tank 12 to separate from mandrel 15 or auger 21, to permit feed tank 12 to be filled while the cavity forming tool is advanced to depth 26 in soil 6, either under its own weight or by application of other force. Tank 12 is positioned on mandrel 15 as column 14 is formed in soil 6.

Figure 5:
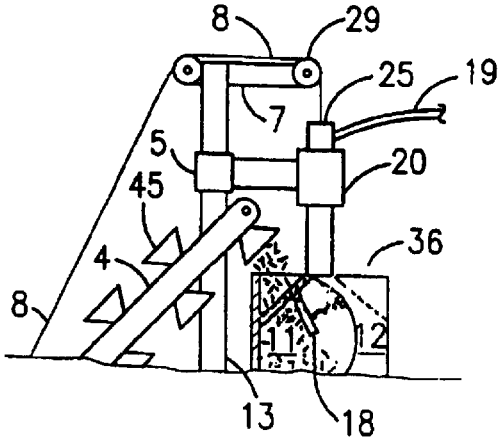
FIG. 5 shows the feed hopper equipped to accept and guide the conveyed or pumped granular material at its inlet where a feed hopper is not needed.

FIG. 5 shows a configuration of which eliminates feed hopper 9 by configuring feed hopper 12 with an extended open collar 36 to guide granular material 11 moved in cradles 45 of by conveyor 4 or pumped from the storage hopper to feed tank. Although not shown, feed tank 12 may be configured to receive backfill 11 pumped from storage hopper 2, and tank 12 may be configured with a means to add defoaming agent to backfill 11 when needed to substantially counteract the effects of foaming agent added to backfill 11 to render it fluid to be moved by pumping. Other elements included in FIG. 5 generally reflect descriptions provided in FIG. 2 and others.

Figure 6:
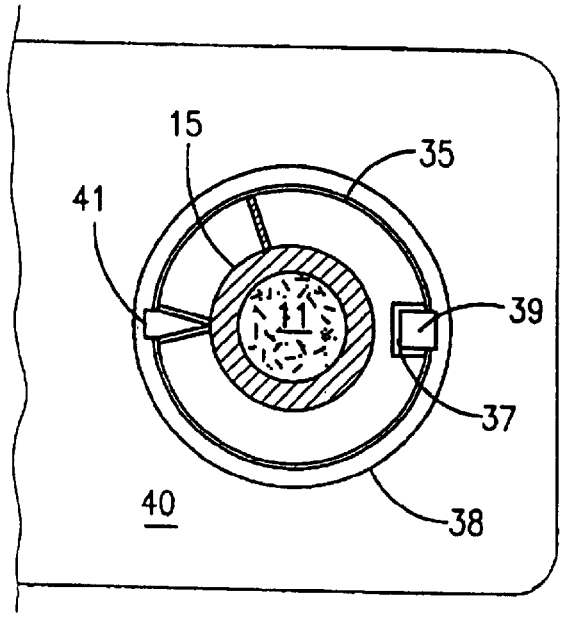
FIG. 6 shows a mandrel with helical flights which are notched or are fixed to the mandrel in segments in a manner to permit the flight auger to move axially as rotational force is applied to the hollow shaft element enabling the rotational force means to be positioned at the low end of the hollow shaft element as compared to its location near its inlet end as shown in FIG. 3 and FIG. 4.

FIG. 6 shows a configuration where helical flight 35 projects from circular mandrel 15. One or more sections of helical flight 35 may be used and each may have one or more notches, 37, positioned within hollow drive shaft, 38, with key 39 attached to drive shaft 38 in a manner to rotate flight 35 and mandrel 15. As the notch 37 is dimensioned to slide axially along key 39 which is fixed to drive shaft 38, mandrel 15 and flight 35 can move within drive 40 as drive shaft 38 is rotated as well as when drive shaft 38 is not rotated. Drive 40 can be positioned at any location along the mandrel, including at or near the low end of support 13 in FIG. 3 where mandrel 15 and helical projection 35 form flight auger 21. A variation of this configuration involves using spaced segments of flight 35, in which instance the notch 35 effectively extends fully through flight 35 as illustrated where key 41 is fixed to shaft 38. Key 39 and key 41 can be in any convenient shape and location as well as an desired length to engage projections of hollow shaft 15 and one or more flights. Configurations of mandrel 15, as well as modifications thereof, can be used where rotation and axial movement are implemented.

Figure 7:
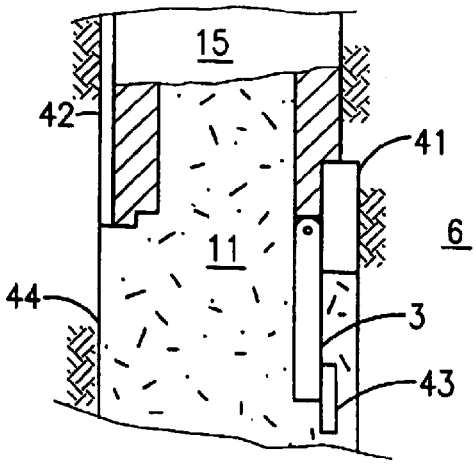
FIG. 7 shows a mandrel with external projections which may be used as means to apply a defoaming agent to the foamed granular material as it is pumped into the cavity to form the column. It is noted that the invention may also be applied as apparatus to strengthen soil with the application of cement or granular cement mix that does not flow freely due to insufficient water in its granular matrix. In this instance, the configuration in FIG. 7 permits water or any mix that can be moved by pump, such as mortar, to be introduced to and combined with the granular material by rotating the shaft, if necessary, as the granular material is moved into the cavity.

FIG. 7 shows a configuration the mandrel, 15, with one or more axial projections, 41. Withdrawal of the mandrel from soil 6 after advancing to the required depth with the outlet end of mandrel 15 closed by cap 3 results in an irregular cavity periphery, 44. Where backfill 11 is moved through mandrel 15 by pumping backfill 11, cap 3 is displaced permitting backfill 11 to fill the cavity to form the column. When the backfill is required to be treated with a defoaming agent, pipe 42 can be provided as a projection to permit introducing a defoaming agent into backfill 11 at the outlet end of mandrel 15. In this instance cap 3 includes an added segment, 43, such that when cap 3 is positioned to close the outlet end of mandrel 15 during its advance to prevent the intrusion of soil 6, segment 43 closes the outlet end of pipe 42 to also prevent the intrusion of soil 6 into pipe 42. The configuration permits water or any pumped material or mix, such as mortar, to be introduced to and combined with the granular material by rotating mandrel 15 as granular material 11 is moved into the cavity to form the column.

In the embodiment of FIG. 1, cap 3 may be smaller than the dimension of mandrel 15 for it to open freely into cavity 10, with cap, 3, seated at the inside of mandrel, 15, as illustrated in FIG. 7.

Variations in methods, embodiments and equipment described and illustrated will be evident to those familiar in the art without deviating from the teachings presented in this disclosure. The use of shaft segments can be applied to the hollow shaft equipment of the present invention with modifications for the needed cavity formation and fill placement teachings of the present invention which may be further varied by applying selected teachings of U.S. Pat. No. 5,647,690.

I claim:

1. Apparatus for the formation of a column of granular material in soil comprising a storage hopper in the vicinity of the base of said apparatus to hold said granular material to form at least one said column in said soil, a hollow shaft means to form a cavity in said soil, a rotary drive means to rotate a substantially linear hollow shaft element of said hollow shaft means about its axis, an axial force means that includes at least a part of the weight of said hollow shaft means to axially advance said hollow shaft element into said soil to a desired depth, a displaceable cap means at the soil penetrating end of said hollow shaft element to prevent soil from entering the hollow of said hollow shaft element advanced into said soil, said cap is displaced to expose said hollow to said cavity to form a flow path for passage of said granular material from said hollow into said cavity formed in said soil as said hollow shaft element is removed from said soil by applying axial force of a magnitude to overcome resisting forces including effects of soil strength and weight of said hollow shaft element, a conveyor means with a granular material pickup end at said storage hopper to incrementally convey said granular material to a delivery end at a reasonably fixed highest point of said conveyor to deliver a desired quantity of said granular material to a feed tank system in the vicinity of said delivery end, said feed tank system includes a feed tank with an entry means to accept said granular material and an outlet means for said granular material to pass through said feed tank system by force which includes fluid supplied under pressure into said feed tank system with said entry means closed when necessary to cause said granular material to flow to the outlet end of said feed tank system into and through said hollow shaft system into said cavity formed on withdrawal of said hollow shaft from said soil by said axial force means able to apply force of a magnitude to overcome resisting forces which include strength effects of said soil and weight of said hollow shaft system, means to support and align said feed tank system and said hollow shaft means to permit movement of said granular material from said storage hopper through said hollow shaft means and into said cavity to complete said column of said granular material in a substantially continuous manner.

2. Apparatus of claim 1 wherein said cavity forming means is a hollow shaft configured with one or more external projections.

3. Apparatus of claim 2 where said projections orient axially along said hollow shaft to define said cavity.

4. Apparatus of claim 3 wherein said axial projections extend for a limited length along said hollow shaft.

5. Apparatus of claim 4 wherein said limited length of said axial projections is in the vicinity of the penetration end of said hollow shaft.

6. Apparatus of claim 2 wherein said projections orient in a helical manner around said hollow shaft to define said cavity.

7. Apparatus of claim 6 where said helical projections extend for a Limited length along said hollow shaft.

8. Apparatus of claim 7 where said limited length is in the vicinity of the penetration end of said hollow shaft.

9. Apparatus of claim 2 wherein said external projections extend for a limited length along said hollow shaft.

10. Apparatus of claim 9 wherein said limited length of said external projections are in the vicinity of the penetration end of said hollow shaft.

11. Apparatus of claim 1 wherein said means to move said granular material from said storage hopper is positioned to discharge said granular material into a feed hopper configured to guide said granular material from said storage hopper into said tank.

12. Apparatus of claim 1 where movement of said material is assisted by fluid under pressure in moving said granular material from said storage hopper to said tank.

13. Apparatus of claim 1 wherein said fluid is air.

14. Apparatus of claim 1 wherein said feed tank is filled at least in part as said mandrel is advanced.

15. Apparatus of claim 1 wherein said feeder end of said conveyor means is positioned to deliver a quantity of said material to a feed hopper in the vicinity of the highest position of said conveyor, said feed hopper being configured with an entry port to accept said material and an outlet for said material to pass material to said feed tank.

16. Apparatus of claim 1 wherein said feed hopper includes a means to expedite passage of said granular material in its passage to said feed tank.

17. Apparatus of claim 16 said means to expedite passage of said granular material is a vibrator of sufficient capacity to continue said flow of said granular material into said feed tank.

18. Apparatus of claim 17 wherein said means to expedite passage of said granular material from said feed hopper to said feed tank is a flow of fluid delivered by a means conjoined with said apparatus to assist and otherwise enable said flow of said granular material into said feed tank by force of gravity.

19. Apparatus of claim 17 wherein said fluid is air.

20. Apparatus of claim 17 said means to expedite passage of said granular material is a vibrator applied to said feed hopper in a manner to prevent arching of said granular material to enable said flow of said granular material by force of gravity.

* * * * *